US009278514B2

(12) United States Patent
Schaede

(10) Patent No.: US 9,278,514 B2
(45) Date of Patent: Mar. 8, 2016

(54) INTAGLIO PRINTING PRESS SYSTEMS FOR RECTO-VERSO INTAGLIO-PRINTING OF SHEETS FOR THE PRODUCTION OF BANKNOTES AND LIKE SECURITIES

(71) Applicant: KBA-NOTASYS SA, Lausanne (CH)

(72) Inventor: Johannes Georg Schaede, Wurzburg (DE)

(73) Assignee: KBA-NOTASYS SA, Lausanne (CH)

( * ) Notice: Subject to any disclaimer, the term of this patent is extended or adjusted under 35 U.S.C. 154(b) by 0 days.

(21) Appl. No.: 14/341,163

(22) Filed: Jul. 25, 2014

(65) Prior Publication Data

US 2014/0338549 A1 Nov. 20, 2014

Related U.S. Application Data

(62) Division of application No. 12/601,320, filed as application No. PCT/IB2008/051931 on May 16, 2008, now Pat. No. 8,794,141.

(30) Foreign Application Priority Data

May 25, 2007 (EP) ..... 07109013

(51) Int. Cl.

| | |
|---|---|
| ***B41F 9/02*** | (2006.01) |
| ***B41F 21/10*** | (2006.01) |
| ***B41M 3/14*** | (2006.01) |
| ***B41F 9/00*** | (2006.01) |
| ***B41F 11/02*** | (2006.01) |
| ***B41F 9/06*** | (2006.01) |
| ***B41F 9/08*** | (2006.01) |

(52) U.S. Cl.

CPC ..... *B41F 9/002* (2013.01); *B41F 9/009* (2013.01); *B41F 9/021* (2013.01); *B41F 9/063* (2013.01); *B41F 9/08* (2013.01); *B41F 11/02* (2013.01); *B41F 21/10* (2013.01); *B41M 3/14* (2013.01); *B65H 2301/42252* (2013.01); *B65H 2801/21* (2013.01)

(58) Field of Classification Search

CPC ..... B41F 9/002; B41F 9/021; B41F 9/02; B41F 21/10; B41F 21/106; B41M 3/14

See application file for complete search history.

(56) References Cited

U.S. PATENT DOCUMENTS

| | | | |
|---|---|---|---|
| 3,303,779 | A | 2/1967 | Giori |
| 4,056,056 | A | 11/1977 | Giori |

(Continued)

FOREIGN PATENT DOCUMENTS

| | | | |
|---|---|---|---|
| BE | 0 901 555 | A1 | 5/1985 |
| CH | 0 414 686 | A | 6/1966 |

(Continued)

*Primary Examiner* — Matthew G Marini
*Assistant Examiner* — Leo T Hinze
(74) *Attorney, Agent, or Firm* — Seager, Tufte & Wickhem LLP

(57) ABSTRACT

Intaglio printing press systems for recto-verso intaglio printing of sheets, in particular for the production of banknotes and the like securities, wherein first and second intaglio printing presses are operatively-coupled to one another by a sheet processing and transporting system comprising an automated guided vehicle system for automatically transporting sheets from a sheet delivery station of the first intaglio printing press where recto printing is performed to a sheet feeding station of the second intaglio printing press where verso printing is performed.

7 Claims, 12 Drawing Sheets

(56) References Cited

U.S. PATENT DOCUMENTS

| | | | | |
|---|---|---|---|---|
| 4,516,496 | A | 5/1985 | Giori | |
| 4,552,066 | A | 11/1985 | Giori et al. | |
| 4,584,939 | A | 4/1986 | Giori | |
| 4,794,856 | A | 1/1989 | Giori | |
| 5,007,339 | A | 4/1991 | Germann | |
| 5,009,156 | A | 4/1991 | Germann | |
| 5,042,378 | A | 8/1991 | Germann | |
| 5,062,359 | A | 11/1991 | Giori | |
| 5,062,360 | A | 11/1991 | Germann et al. | |
| 5,282,417 | A | 2/1994 | Germann | |
| 5,467,710 | A | 11/1995 | Wirz | |
| 5,479,856 | A | 1/1996 | Wirz | |
| 5,664,934 | A | 9/1997 | Schaede et al. | |
| 5,738,487 | A | 4/1998 | Schaede et al. | |
| 5,899,145 | A | 5/1999 | Schaede | |
| 6,071,069 | A | 6/2000 | Wyssmuller et al. | |
| 6,101,939 | A | 8/2000 | Giori et al. | |
| 6,231,292 | B1 | 5/2001 | Wyssmuller et al. | |
| 6,272,987 | B1 * | 8/2001 | Kamoda | 101/153 |
| 6,508,172 | B2 * | 1/2003 | Kusaka | 101/483 |
| 6,883,429 | B2 | 4/2005 | Kamoda | |
| 8,065,957 | B2 | 11/2011 | Schaede et al. | |
| 8,794,141 | B2 * | 8/2014 | Schaede | 101/152 |
| 2005/0042072 | A1 | 2/2005 | Amdahl et al. | |
| 2007/0181016 | A1 | 8/2007 | Schaede | |

FOREIGN PATENT DOCUMENTS

| | | | |
|---|---|---|---|
| CH | 0 480 175 | A | 10/1969 |
| CH | 0 566 210 | A5 | 9/1975 |
| DE | 0 949 474 | C | 9/1956 |
| DE | 0 958 385 | C | 2/1957 |
| DE | 1 561 068 | B1 | 4/1970 |
| EP | 0 091 709 | A1 | 10/1983 |
| EP | 0 132 857 | A1 | 2/1985 |
| EP | 0 136 972 | A1 | 4/1985 |
| EP | 0 343 105 | A2 | 11/1989 |
| EP | 0 343 106 | A2 | 11/1989 |
| EP | 0 351 366 | A2 | 1/1990 |
| EP | 0 406 157 | A1 | 1/1991 |
| EP | 0 563 007 | A1 | 9/1993 |
| EP | 0 725 027 | A2 | 8/1996 |
| EP | 0 870 712 | A1 | 10/1998 |
| EP | 0 873 866 | A1 | 10/1998 |
| EP | 0 949 069 | A1 | 10/1999 |
| EP | 1 602 482 | A1 | 12/2005 |
| GB | 393 992 | A | 6/1933 |
| GB | 761 456 | A | 11/1956 |
| GB | 1 304 592 | A | 1/1973 |
| GB | 1 452 002 | A | 10/1976 |

* cited by examiner

INTAGLIO PRINTING PRESS SYSTEMS FOR RECTO-VERSO INTAGLIO-PRINTING OF SHEETS FOR THE PRODUCTION OF BANKNOTES AND LIKE SECURITIES

RELATED APPLICATIONS

This application is a divisional of U.S. application Ser. No. 12/601,320, filed Jan. 18, 2010, which is a 371 of PCT/IB08/51931, filed May 16, 2008, which claims the priority of EP 07109013.8, filed May 25, 2007.

TECHNICAL FIELD

The present invention relates to printing press systems for recto-verso intaglio printing of sheets for the production of banknotes and the like securities.

BACKGROUND OF THE INVENTION

The term "intaglio printing" as used herein refers to direct plate printing using engraved printing plates as commonly used for the production of banknotes and security documents. Banknotes, for example, are typically provided with intaglio-printed patterns (such as portraits or other pictorial representations, latent images, guilloche patterns, denominations, bank designation, etc.) which are readily recognizable by touch due to the embossing and tactile effect inherent to intaglio printing.

Intaglio printing is to be distinguished from so-called gravure or rotogravure printing (or "Tiefdruck" in German) which makes use of engraved cylinders provides with arrays of cells of varying depth and/or width and is performed using low viscosity inks and low printing pressures. In contrast, intaglio printing is carried out using high viscosity, pasty inks and high printing pressures and produces a characterizing relief and embossing on the resulting printed products, which relief and embossing might be recognized by touch.

Sheet-fed intaglio printing presses are for instance known from European patent applications Nos. EP 0 091 709 A1, EP 0 406 157 A1, EP 0 563 007 A1, EP 0 873 866 A1, EP 1 602 482 A1 all in the name of the present Applicant. These printing presses are only adapted to carry out intaglio printing of one side of the sheets.

European patent applications Nos. EP 0 343 105 A2, EP 0 343 106 A2, EP 0 949 069 A1, all in the name of the present Applicant, disclose sheet-fed offset printing presses for simultaneous recto-verso printing of sheets for the production of banknotes and the like securities. These offset printing presses, also commonly referred to as Simultan-type presses, are used to print multicolour backgrounds on both sides of the sheets simultaneously and with precise recto-verso register.

European patent applications EP0 132 857A1 (which corresponds to BE 901 555), EP0 136 972A1 and EP 0 351 366 A2, all in the name of the present Applicant, disclose so-called combined printing presses for performing offset printing and intaglio printing of sheets for the production of banknotes and the like securities in one pass. Offset printing is performed on one or both sides of the sheets in an offset printing unit, which sheets are then fed to a downstream-located intaglio printing unit which prints the sheets on only one side.

German patent DE 1 561 068 B1 discloses a four-colour offset printing press for single-side or recto-verso printing of sheets, which printing press includes first and second printing units disposed in a mirrored configuration. Each printing unit comprises first and second blanket cylinders and associated forme cylinders inked by corresponding inking devices. The two printing units are each adapted to be configured to perform either single-side printing or recto-verso printing of the sheets. For single-side printing of the sheets, each printing unit is configured so that the first and second blanket cylinders cooperate with the same side of the sheets and the sheets are conveyed from the first to the second printing unit by means of a first chain conveyor system running below the printing units. For recto-verso printing of the sheets, each printing unit is configured so that the first and second blanket cylinders cooperate with opposite sides of the sheets and the sheets are conveyed from the first to the second printing unit by means of a second chain conveyor system running above the first chain conveyor system. Recto-verso printing is thus performed in a simultaneous manner in each printing unit.

British patent GB 393,992 A discloses a sheet conveying device for coupling of individual printing presses in tandem configuration. The sheet conveying device is coupled to the chain conveyor system of the first printing press, downstream of the sheet delivery station thereof. In order to perform recto-verso printing of the sheets, a sheet-turning device is further provided, which sheet-turning device is coupled to the chain conveyor system of the first printing press so that sheets can be deposited on the sheet conveying device with their printed side oriented downwards. The thus turned sheets are then fed by the sheet conveying device to the downstream located second printing press.

German patent DE 949 474 C (which corresponds to British patent GB 761,456 A) discloses a sheet-fed rotogravure printing press for multicolour printing consisting of several identical printing units disposed in tandem configuration and each provided with its own feed table and delivery chain conveyor system. The delivery chain conveyor system of each printing unit transfers the printed sheets to a secondary delivery chain system which is placed above the feed table of the subsequent printing unit where the sheets are deposited in an overlapping formation. The secondary delivery chain system can be selectively operated to perform reversal of the sheets before deposition thereof onto the underlying feed table so as to carry out recto-verso printing of the sheets. According to German patent DE 949 474 C, the sheets are dropped by the secondary delivery chain system in an overlapped manner on the subsequent feed table, which requires re-alignment and separation of each individual sheet before it can be fed to the subsequent printing unit.

German patent DE 958 385 C discloses a sheet-fed rotogravure printing press for multicolour printing which is only adapted to perform single-side printing of the sheets.

US patent application No. US 2005/0042072 A1 discloses a transportation system for sheet delivery between sheet or sheet stack processing equipment. A sheet or sheet stack processing module is configured to include one or more transfer stations for receiving either single sheets of stacks of sheets to be passed onto the processing module, each transfer station comprising a slotted platform around which a belt rotates to pass sheets deposited on the platform to the sheet or sheet stack processing module. The platform is slotted so as to have a plurality of alternating platform fingers and platform slots that may intermesh with the platform fingers and slots of another transfer station or of a moveable transportation cart having a slotted deck. In this way, the output of a first sheet or sheet stack processing module may be directly coupled to the input of a subsequent sheet or sheet stack processing module. This publication does not teach any sort of automated guided vehicle system for transferring sheets between two remote locations. The transportation system of US 2005/0042072 A1 is suitable for use in the context of office printing equipment such as photocopiers or digital printers. This solution is however not adapted in the context of industrial sheet-fed printing presses, such as used for the production of securities, due in particular to the configuration of sheet feeders and sheet deliveries of sheet-fed printing presses. It is in particular not possible to directly couple the sheet delivery of a sheet-fed printing press to the sheet feeder of another printing press using a system as taught in US 2005/0042072 A1.

Simultaneous recto-verso printing as taught in EP 0 132 857 A1. EP 0 343 105 A2, EP 0 343 106 A2, EP 0 351 366 A2, EP 0 949 069 A1 or DE 1 561 068 B1 is not applicable in practice to intaglio printing which requires a compromise between a hard surface on the printing side (i.e. where the plate cylinder and intaglio printing plate(s) are located) to ensure precise printing and an elastic surface on the opposite side (i.e. where the impression cylinder is located) to ensure that the sheets are properly pressed against the hard surface of the intaglio printing plate(s) and into the engravings thereof to catch the ink contained therein. A solution for simultaneous recto-verso printing was proposed in Swiss patent No. CH414 686A5 in the name of the present Applicant, but this solution has never been put successfully into practice because of the above-mentioned necessary compromise.

Security against forgery is improved by providing intaglio patterns on both sides of the printed sheets. This is typically performed in two separate intaglio printing presses each equipped with a corresponding set of intaglio printing plates for the back side and the front side of the sheets. Sheets processed by the first printing press are transported manually to the sheet feeding station of the second printing press.

SUMMARY OF THE INVENTION

A general aim of the invention is to provide an intaglio printing press system that facilitates the recto-verso intaglio printing of sheets.

These aims are achieved thanks to the intaglio printing press systems defined in the claims.

According to a first aspect of the invention, there is provided an intaglio printing press system for recto-verso printing of sheets for the production of banknotes and the like securities, which comprises first and second intaglio printing presses which are operatively-coupled to one another by a sheet processing and transporting system comprising an automated guided vehicle system for automatically transporting sheets from a sheet delivery station of the first intaglio printing press where recto printing is performed to a sheet feeding station of the second intaglio printing press where verso printing is performed.

According to a second aspect of the invention, there is provided an intaglio printing press system for recto-verso printing of sheets for the production of banknotes and the like securities, which comprises first and second intaglio printing units each comprising an impression cylinder cooperating with a plate cylinder carrying at least one intaglio printing plate which is inked by an inking system and wiped by a wiping system, the first and second intaglio printing units being operatively-coupled to one another directly by a sheet transporting system comprising a chain conveyor system with spaced-apart gripper bars for transporting the sheets from the first intaglio printing unit where recto printing is performed to the second intaglio printing unit where verso printing is performed. According to this second aspect, the first and second intaglio printing units are disposed in a mirrored configuration such that the impression cylinder and the plate cylinder of the first intaglio printing unit rotate in directions opposite to the directions of the impression cylinder and the plate cylinder of the second intaglio printing unit. Thanks to the this mirrored configuration, the sheets can conveniently and simply be transferred from the first intaglio printing unit where recto printing occurs to the second intaglio printing unit where verso printing occurs without this necessitating any sheet turning device.

According to an advantageous embodiment of this second aspect of the invention, the sheets are taken away from the impression cylinder of the first intaglio printing unit by the chain conveyor system and the sheet transporting system further comprises a transfer drum or cylinder placed between the impression cylinder of the second intaglio printing unit and a downstream end of the chain conveyor system for transferring the sheets from the chain conveyor system directly to the impression cylinder of the second intaglio printing unit. This ensures a particularly simple and efficient transfer of the sheets from the first to the second intaglio printing unit.

According to a third aspect of the invention, there is provided an intaglio printing press system for recto-verso printing of sheets for the production of banknotes and the like securities, which comprises first and second intaglio printing units each comprising an impression cylinder cooperating with a plate cylinder carrying at least one intaglio printing plate which is inked by an inking system and wiped by a wiping system, the first and second intaglio printing units being operatively-coupled to one another directly by a sheet transporting system for transporting the sheets from the first intaglio printing unit where recto printing is performed to the second intaglio printing unit where verso printing is performed. According to this third aspect, the first and second intaglio printing units are disposed vertically, one on top of the other. This third aspect is advantageous in that the footprint of the intaglio printing press is of the same order as that of a single-side intaglio printing press.

According to an advantageous embodiment of this third aspect of the invention, the impression cylinders and the plate cylinders of the first and second intaglio printing units are disposed in a mirrored configuration such that the impression cylinder and the plate cylinder of the first intaglio printing unit rotate in directions opposite to the directions of the impression cylinder and the plate cylinder of the second intaglio printing unit. Thanks to the this mirrored configuration, the sheets can be conveniently and simply be transferred from the first intaglio printing unit where recto printing occurs to the second intaglio printing unit where verso printing occurs without this necessitating any sheet turning device.

According to another advantageous embodiment of this third aspect of the invention, the sheet transporting system comprises a pair of transfer cylinders or drums for transporting the sheets directly from the impression cylinder of the first intaglio printing unit to the impression cylinder of the second intaglio printing unit. This again ensures a particularly simple and efficient transfer of the sheets from the first to the second intaglio printing unit.

According to yet another advantageous embodiment of the third aspect of the invention, the inking systems of the first and second intaglio printing units are located on a same side. This ensures a particularly stable construction of the whole intaglio printing press system.

According to a fourth aspect of the invention, there is provided an intaglio printing press system for recto-verso printing of sheets for the production of banknotes and the like securities, which comprises first and second intaglio printing units each comprising an impression cylinder cooperating with a plate cylinder carrying at least one intaglio printing plate which is inked by an inking system and wiped by a wiping system, the first and second intaglio printing units being operatively-coupled to one another directly by a sheet transporting system comprising a chain conveyor system with spaced-apart gripper bars for transporting the sheets from the first intaglio printing unit where recto printing is performed to the second intaglio printing unit where verso printing is performed. According to this fourth aspect, the first and second intaglio printing units are disposed in a tandem configuration such that the impression cylinder and the plate cylinder of the first intaglio printing unit rotate in the same directions as the impression cylinder and the plate cylinder of the second intaglio printing unit, the sheet transporting system further comprising a sheet transfer arrangement for performing reversal of the sheet transport direction of the sheets before transfer thereof directly to the impression cylinder of the second intaglio printing unit. Thanks to this configuration, the sheets are transferred directly to the impression cylinder of the second intaglio printing unit without loosing sheet register.

According to an advantageous embodiment of this fourth aspect of the invention, the sheets are taken away from the impression cylinder of the first intaglio printing unit by the chain conveyor system and the sheet transfer arrangement comprises a first transfer drum or cylinder placed at a downstream end of the chain conveyor system for getting hold of a trailing edge of the sheets transported by the chain conveyor system.

According to another advantageous embodiment of the fourth aspect of the invention the sheet transfer arrangement further comprises a second transfer drum or cylinder placed between the impression cylinder of the second intaglio printing unit and the first transfer drum or cylinder for transferring the sheets from the first transfer drum or cylinder directly to the impression cylinder of the second intaglio printing unit The expression "printing press" used in the context of the first aspect of the invention shall be understood as referring to a complete printing press with its sheet feeding and sheet delivery stations, whereas the expression "printing unit" used in the context of the second to fourth aspects of the invention shall be understood as referring to a printing group that forms part of a same printing press. In other words, according to the second to fourth aspects of the invention, the intaglio printing press system consists of a single printing press with two printing units operatively-coupled to one another, whereas, according to the first aspect of the invention, the intaglio printing press system consists of two printing presses that are operatively-coupled to one another.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1A:
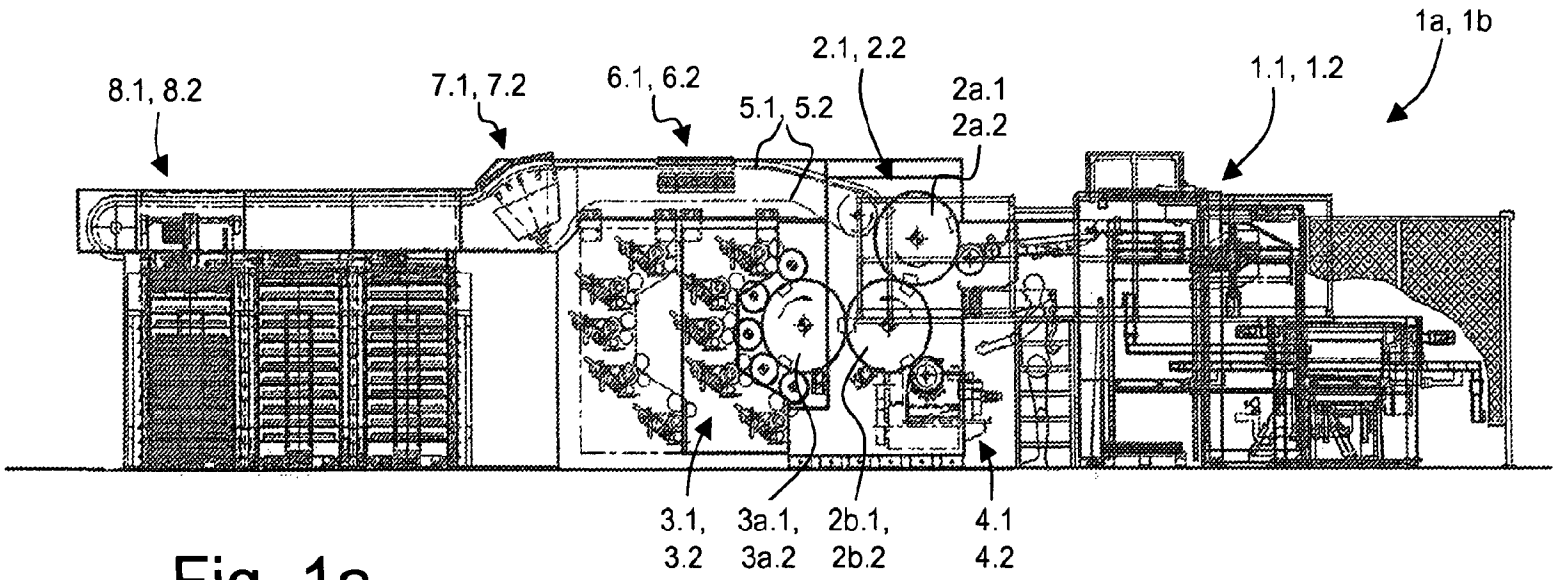
FIGS. 1*a* to 1*c* are schematic views of a first embodiment of an intaglio printing press system for recto-verso printing of sheets according to the invention.

The intaglio printing press systems which will be described in the following for the sake of illustration all basically share a more or less identical or similar configuration as far as the printing units for recto printing and the printing units for verso printing are concerned. As this will be apparent from the following description, each printing unit, whether for recto printing or verso printing of the sheets, exhibits a configuration similar to that disclosed in European patent application EP 0 406 157 A1 in the name of the present Applicant, which application is incorporated herein by reference in its entirety.

More precisely, each printing unit at least comprises (i) an impression cylinder, (ii) a plate cylinder carrying intaglio printing plates and contacting the impression cylinder to form a printing nip therebetween where the sheets are actually printed, (iii) an inking system for inking the intaglio printing plates carried by the plate cylinder, and (iv) a wiping system for wiping the surface of the inked intaglio printing plates prior to printing.

In the below-discussed embodiments, the inking system is preferably an indirect inking system, i.e. an inking system wherein a multi-colour ink pattern formed by means of a plurality of inking devices is first collected on an ink-collecting cylinder (or "Orlof cylinder") contacting the surface of the plate cylinder. Alternatively, so-called direct inking systems wherein one or more inking devices directly ink the surface of the plate cylinder are also possible. Indirect inking systems are however preferred in that they permit substantial ink savings. A combination of indirect and direct inking systems is also possible (see for instance European patent application EP 0 091 709 A1 in that respect). Within the scope of the present invention, the actual configuration of the inking system is not as such critical and is not to be regarded as being a factor limiting the scope of the invention as claimed.

According to the exemplary embodiments given below, the impression cylinder, the plate cylinder and the ink-collecting cylinder all advantageously have the same diameter, in this case a "triple-sized" diameter, that is, a diameter such that each cylinder comprises three segments (i.e. three blankets in the case of the impression cylinder and ink-collecting cylinder, and three intaglio printing plates as regards the plate cylinder). The diameter or size ratio of the impression cylinder, plate cylinder and ink-collecting cylinder can thus be expressed as 3:3:3. Any other diameter or size ratio among the impression cylinder, plate cylinder and ink-collecting cylinder is however possible, such as for example 3:3:2 (as in the case of the printing presses described in European patent applications EP 0 091 709 A1 and EP 0 873 866 A1, which are both incorporated herein by reference in their entirety), 2:3:2 or 2:3:3 (as illustrated in FIGS. 2 and 3 of European patent application EP 1 602 482 A1 which is also incorporated herein by reference in its entirety), 2:2:2 (as disclosed in European patent application EP 0 563 007 A1), 3:3:4, 3:4:4, 4:4:4, etc. All possible permutations will not be listed herein for the sake of conciseness. In general, the diameter or size ratio among the impression cylinder, plate cylinder and ink-collecting cylinder can be X:Y:Z, where X, Y, Z respectively designate the number of segments (or size) of the impression cylinder, the plate cylinder and the ink-collecting cylinder, values X, Y, Z being integer numbers preferably equal to 1, 2, 3, 4 or 5. While greater numbers of segments (or sizes) are possible (i.e. X, Y, Z>5), this implies relatively large machine configurations for a given size of sheets to be processed. Values X, Y, Z are therefore preferably kept in practice at low values ranging from 1 to 5, preferably from 1 to 4, even more preferably from 1 to 3.

Triple-sized cylinders, as disclosed in EP 0 406 157 A1, for instance allow the use of up to five distinct inking devices placed around the periphery of the ink-collecting cylinder (as illustrated in the Figures). A greater number of inking devices might necessitate increasing the size of the ink-collecting cylinder to a greater size in order to provide more space for additional inking devices.

Preferably, the impression cylinder, the plate cylinder and the ink-collecting cylinders are disposed in such a way that contact and passage of the respective segments and cylinder pits typically present between the segments of the three cylinders are synchronized as described in European patent application EP 1 602 482 A1, which is incorporated herein more particularly in that respect. This also preferably applies to the arrangement of the wiping system with respect to the plate cylinder, which wiping system typically includes a wiping roller rotating in the same direction as the plate cylinder.

The following reference numerals are used in the Figures and in the following description:

1*a*, 1*b*: intaglio printing press (first, respectively second)
1.1, 1.2: sheet feeding location/station
2.1, 2.2: intaglio printing unit
2*a*.1, 2*a*.2: impression cylinder
2*b*.1, 2*b*.2: plate cylinder (with intaglio printing plates)
3.1, 3.2: inking system (indirect)
3*a*.1, 3*a*.2: ink-collecting cylinder ("Orlof" cylinder)
4.1, 4.2: wiping unit/system
5.1, 5.2: endless chain conveyor system (with spaced-apart gripper bars for holding the leading edge of the sheets)
6.1, 6.2: drying unit/system (e.g. infrared or UV)
7.1, 7.2: inspection system for quality control (recto-side, respectively verso-side)
8.1, 8.2: sheet delivery location/station
9: sheet processing and transporting system (with automated guided vehicle system or "AGV")
10.1: transfer cylinder/drum
11: sheet feeding location/station
12.1, 12.2: intaglio printing unit (first, respectively second)
12*a*.1, 12*a*.2: impression cylinder
12*b*. 1, 12*b*.2: plate cylinder (with intaglio printing plates)
13.1, 13.2: inking system (indirect)
13*a*. 1, 13*a*.2: ink-collecting cylinder ("Orlof" cylinder)
14.1, 14.2: wiping unit/system
15.1, 15.2: endless chain conveyor system (with spaced-apart gripper bars for holding the leading edge of the sheets)
16.1: drying unit/system (e.g. infrared or UV)
17.1, 17.2: inspection system for quality control (recto-side, respectively verso-side)
18: sheet delivery location/station
20.1: transfer cylinder/drum
21: sheet feeding location/station
22.1, 22.2: intaglio printing unit (first, respectively second)
22*a*.1, 22*a*.2: impression cylinder
22*b*. 1, 22*b*.2: plate cylinder (with intaglio printing plates)
23.1, 23.2: inking system (indirect)
23*a*. 1, 23*a*.2: ink-collecting cylinder ("Orlof" cylinder)
24.1, 24.2: wiping unit/system
25.1, 25.2: endless chain conveyor system (with spaced-apart gripper bars for holding the leading edge of the sheets)
26.1: drying unit/system (e.g. infrared or UV)
27.1, 27.2: inspection system for quality control (recto-side, respectively verso-side)
28: sheet delivery location/station
30.1, 30.2: transfer cylinder/drum
31: sheet feeding location/station
32.1, 32.2: intaglio printing unit (first, respectively second)
32*a*.1, 32*a*.2: impression cylinder
32*b*. 1, 32*b*.2: plate cylinder (with intaglio printing plates)
33.1, 33.2: inking system (indirect)
33*a*. 1, 33*a*.2: ink-collecting cylinder ("Orlof" cylinder)
33*b*.2: ink-transfer cylinder
34.1, 34.2: wiping unit/system
35: endless chain conveyor system (with spaced-apart gripper bars for holding the leading edge of the sheets)
36.1, 36.2: drying unit/system (e.g. infrared or UV)
37: inspection system for quality control (verso side)
38: sheet delivery location/station
40: sheet transfer arrangement (leading edge-trailing edge sheet transfer/substitution)
40.1: transfer cylinder/drum (for reversal of sheet transporting direction)
40.2: transfer cylinder/drum
41: sheet feeding location/station
42.1, 42.2: intaglio printing unit (first, respectively second)
42*a*.1, 42*a*.2: impression cylinder
42*b*. 1, 42*b*.2: plate cylinder (with intaglio printing plates)
43.1, 43.2: inking system (indirect)
43*a*. 1, 43*a*.2: ink-collecting cylinder ("Orlof" cylinder)
44.1, 44.2: wiping unit/system
45.1, 45.2: endless chain conveyor system (with spaced-apart gripper bars for holding the leading edge of the sheets)
45*a*. 1: chain wheels (at sheet transfer location of conveyor system 45.1)
46.1, 46.2: drying unit/system (e.g. infrared or UV)
47.1, 47.2: inspection system for quality control (recto-side, respectively verso-side)
48: sheet delivery location/station The endless chain conveyor systems 5.1, 5.2, 15.1, 15.2, 25.1, 25.2, 35, 45.1, 45.2 are as such known in the art and do not need to be described in detail here. Such conveyor systems typically comprise a pair of endless chains driven into rotation by chain wheels, gripper bars being attached to the endless chains at selected intervals in order to hold sheets to be transported by their leading edges.

The inspection systems 7.1, 7.2, 17.1, 17.2, 27.1, 27.2, 37, 47.1, 47.2 are also known as such in the art. A suitable inspection system for this application is for instance disclosed in International application No. WO 03/070465 A1 which is assigned to the present Applicant.

The drying units 6.1, 6.2, 16.1, 26.1 36.1, 36.2, 46.1, 46.2 may be any suitable drying device, especially an infrared drying device or heating-generating device, or a UV (ultraviolet) drying device, depending on the type of intaglio printing ink used.

Figure 1B:
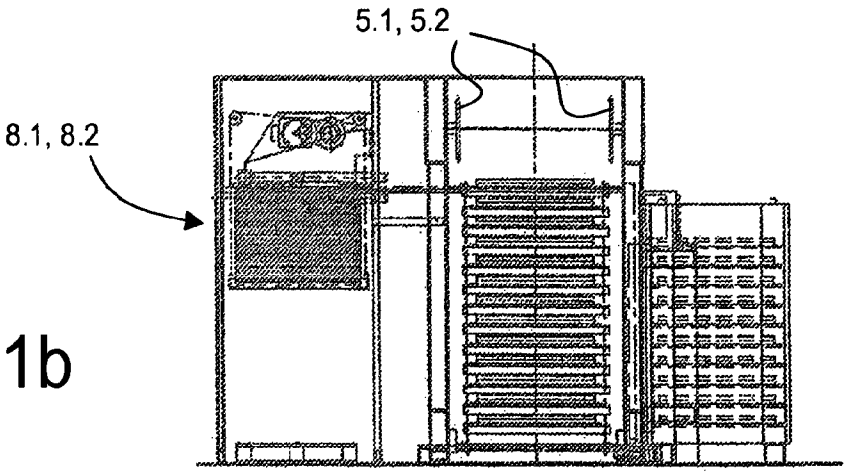

A first embodiment of the invention will now be described in reference to FIGS. 1*a* to 1*c*. According to this first embodiment, the intaglio printing press system comprises first and second intaglio printing presses 1*a*, 1*b* respectively for recto and verso printing, which intaglio printing presses 1*a*, 1*b* are operatively-coupled to one another by a sheet processing and transporting system 9 (see FIG. 1*c*) comprising an automated guided vehicle (referred to by acronym AGV) system which automatically transports loads of sheets processed by the first intaglio printing press 1*a* from the sheet delivery station 8.1 thereof to the sheet feeding station 1.2 of the second intaglio printing press 1*b* in order to be further processed. According to this first embodiment, the first and second intaglio printing presses 1*a*, 1*b* exhibit identical configurations (different configurations could alternatively be used depending on the actual job to carry out).

Figure 1C:
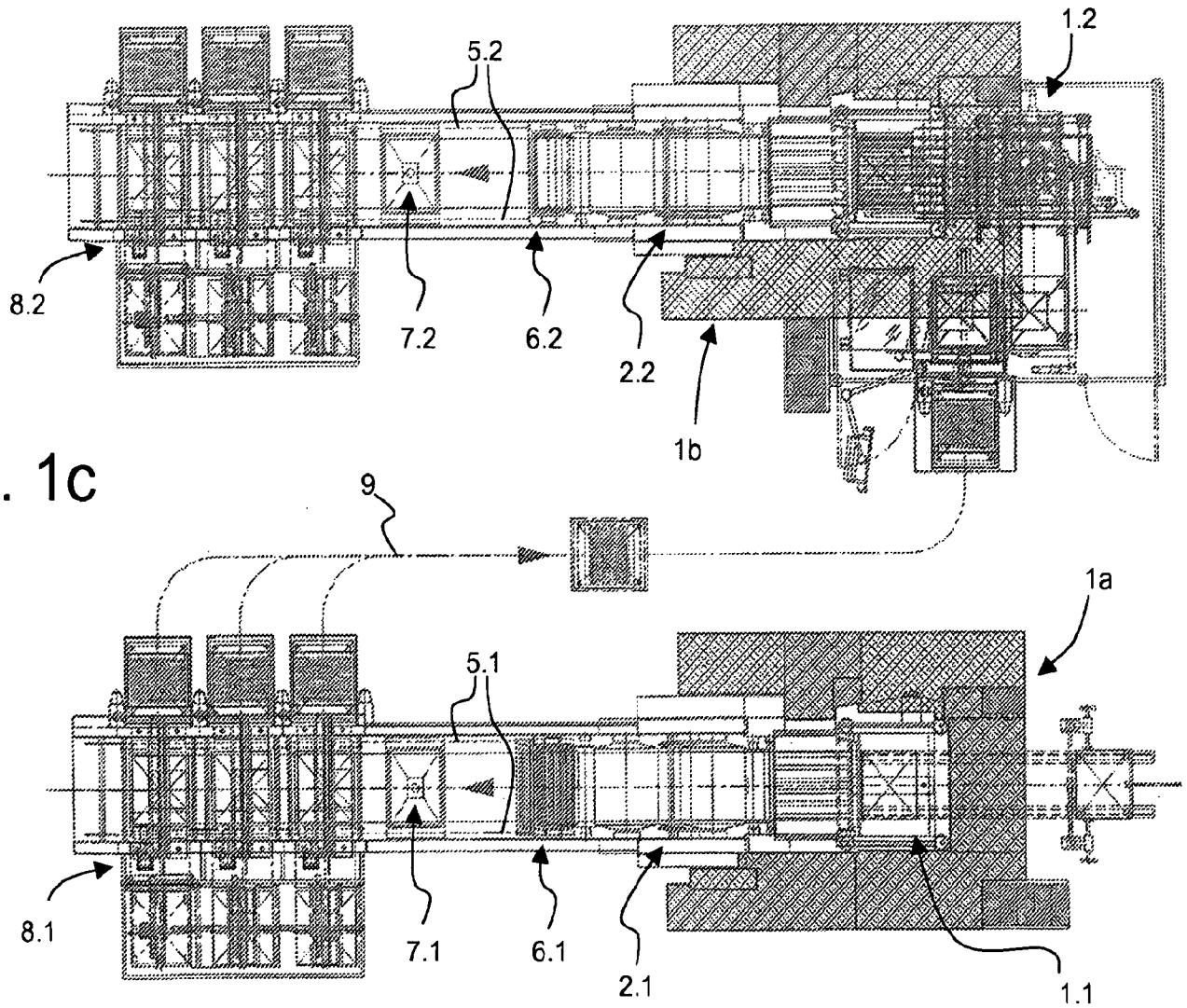

As illustrated in FIG. 1*c*, the two intaglio printing presses 1*a*, 1*b* are disposed with the same orientation, i.e. with the sheet feeding stations 1.1, 1.2 thereof oriented on the right-hand side in FIG. 1*c* and the sheet delivery stations 8.1, 8.2 oriented on the left-hand side. According to a variant, the two intaglio printing presses 1*a*, 1*b* could be oriented in a head-to-tail configuration, i.e. with opposite directions.

Automated guided vehicle systems are known as such in the art and do not need to be described in detail in the present description. These AGV systems are used for a wide variety of logistical applications where loads of material or processed items have to be transported from one processing location to another. Within the scope of the present invention, care should be taken that the AGV system is adapted to be coupled to the output (sheet delivery station of the first intaglio printing press 1*a* and to the input (sheet feeding station of the second intaglio printing press 1*b*.

Preferably, the sheet processing and transporting system 9 may additionally comprise one or more buffers (not illustrated) for temporarily storing the sheets produced by the first intaglio printing press 1*a*. The advantage of such buffers is to enable temporary storage of the sheets already printed by the first intaglio printing press 1*a* in case of machine halts or maintenance operations on the second intaglio printing press 1*b*.

In the context of this first embodiment, the sheet processing and transporting system 9 preferably further comprises an automated unloading apparatus for unloading the loads of sheets from the sheet delivery station 8.1 of the first intaglio printing press 1*a*. Such an unloading apparatus is for instance taught in European patent application EP 0 870 712 A1 in the name of the present Applicant, which is incorporated herein by reference. A similar system might be used to automatically load the partially-printed sheets at the sheet feeding station 1.2 of the second intaglio printing press 1*b*. Such automated unloading or loading apparatus might also be provided with pile-robot systems for manipulating the sheets by processing sets of sheets placed on vertically superposed stacking boards of a paternoster system, either in an individual manner (i.e. one stacking board at a time) or in a simultaneous manner (i.e. several stacking boards at a time).

Advantageously, an automated stacking board inserting apparatus might also be provided at the sheet delivery station 8.1, 8.2 of the first and/or second intaglio printing presses 1*a*, 1*b* in order to automatically insert a new stacking board on top of a previous stacking board onto which a complete set of sheets has been delivered. Such an automated stacking board inserting apparatus (and stacking boards for use therewith) is disclosed in European patent application EP 0 725 027 A2 which is incorporated herein by reference in its entirety.

According to the first embodiment, one will appreciate and understand that the side of the sheets which is freshly printed (i.e. the recto side on the first intaglio printing press 1*a* and the verso side on the second intaglio printing press 1*b*) is oriented towards the exterior of the corresponding impression cylinder 2*a*.1, 2*a*.2. In the chain conveyor system 5.1, 5.2 which delivers the sheets from the printing unit 2.1, 2.2 to the sheet delivery unit 8.1, 8.2 (which chain conveyor system 5.1, 5.2 runs in a counter-clockwise direction in the illustration of FIG. 1*a*), the freshly printed sheets are oriented with their freshly-printed side oriented downwards, past the drying unit 6.1, 6.2 and the inspection unit 7.1, 7.2. Before being delivered in the sheet delivery unit 8.1, 8.2, the sheets are subjected to a 180° rotation and thus delivered with their freshly-printed side oriented upwards. In other words, once printed on the first intaglio printing press 1*a*, the sheets are oriented with their recto-side oriented upwards. The sheets are directly transferred with this same orientation to the sheet feeding station 1.2 of the second intaglio printing press 1*b*. The recto-side of the sheets which was printed on the first intaglio printing press is thus oriented towards the interior of the impression cylinder 2*a*.2 of the second intaglio printing press 1*b* where the verso-side is printed. The sheet delivered at the output 8.2 of the second intaglio printing press 1*b*, which are printed on the recto and verso sides, are oriented with their verso-side oriented upwards.

For the sake of explanation and illustration, white and black triangles indicating the orientation of the printed sheets will be used in the illustrations of FIGS. 2*a*-2*c*, 3*a*-3*c*, 4*a*, 4*b*, 5*a* and 5*b* to respectively designate the printed recto-side and the printed verso-side of the sheets.

Figure 2A:
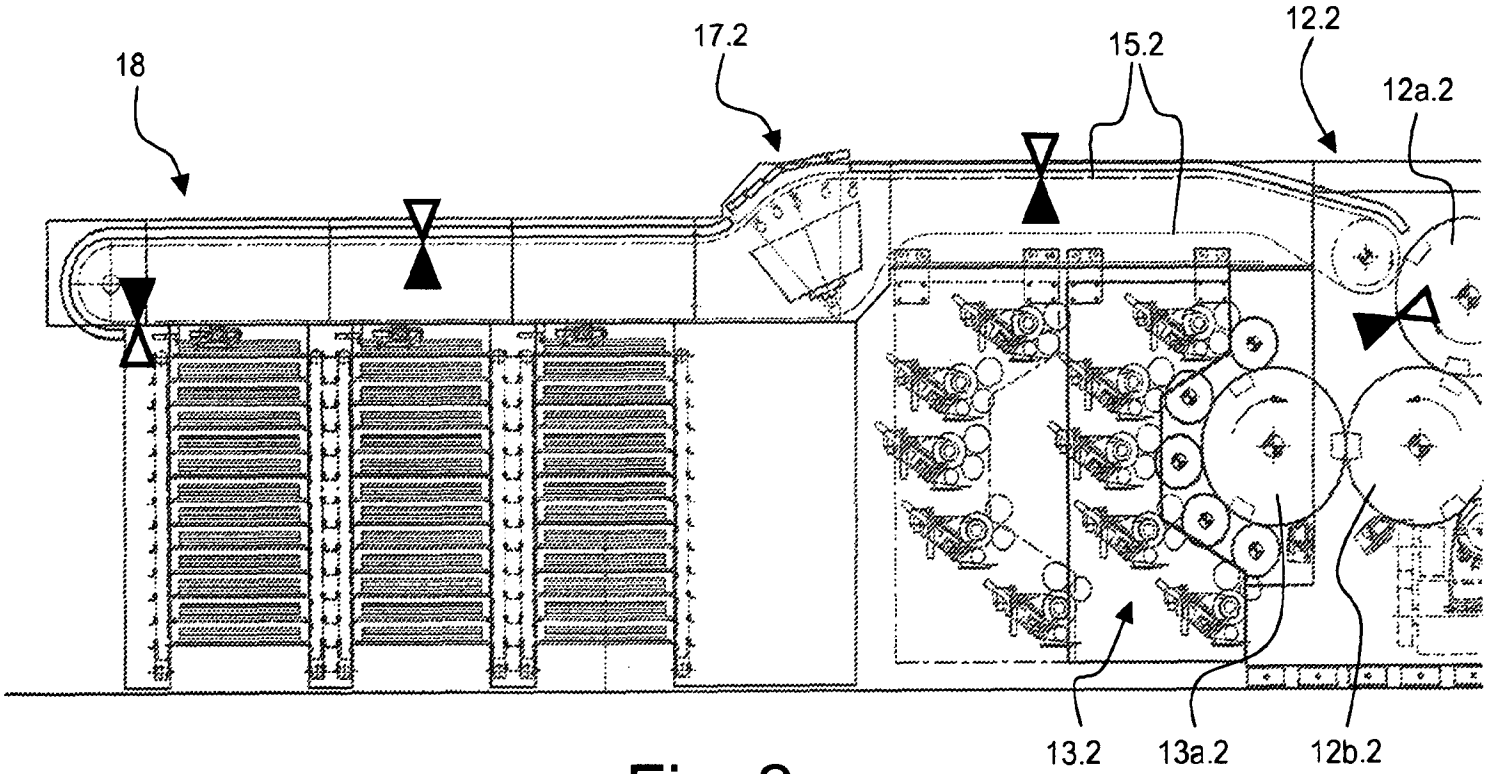
FIGS. 2*a* to 2*c* are schematic views of a second embodiment of an intaglio printing press system for recto-verso printing of sheets according to the invention.
Figure 2B:
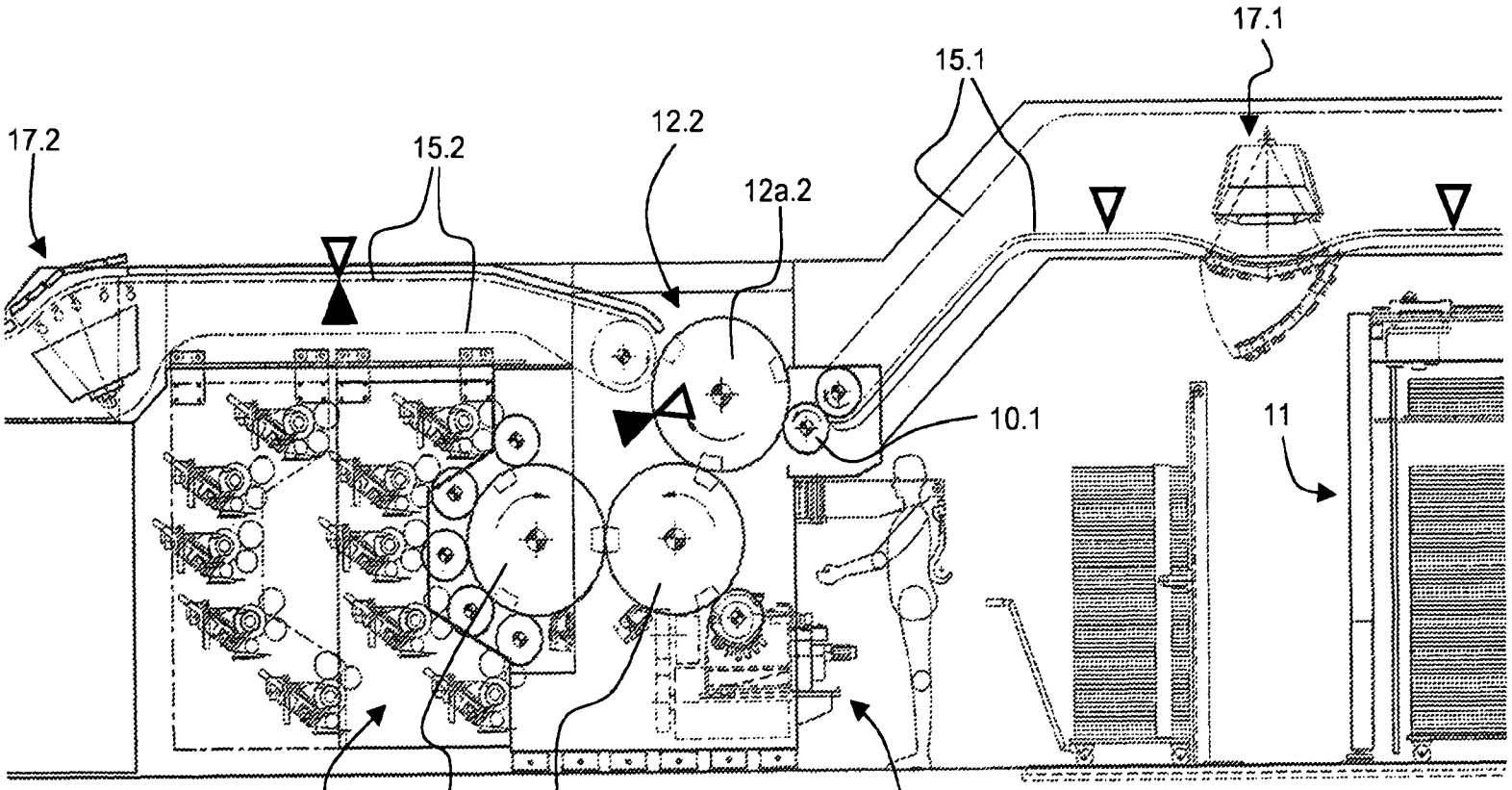
Figure 2C:
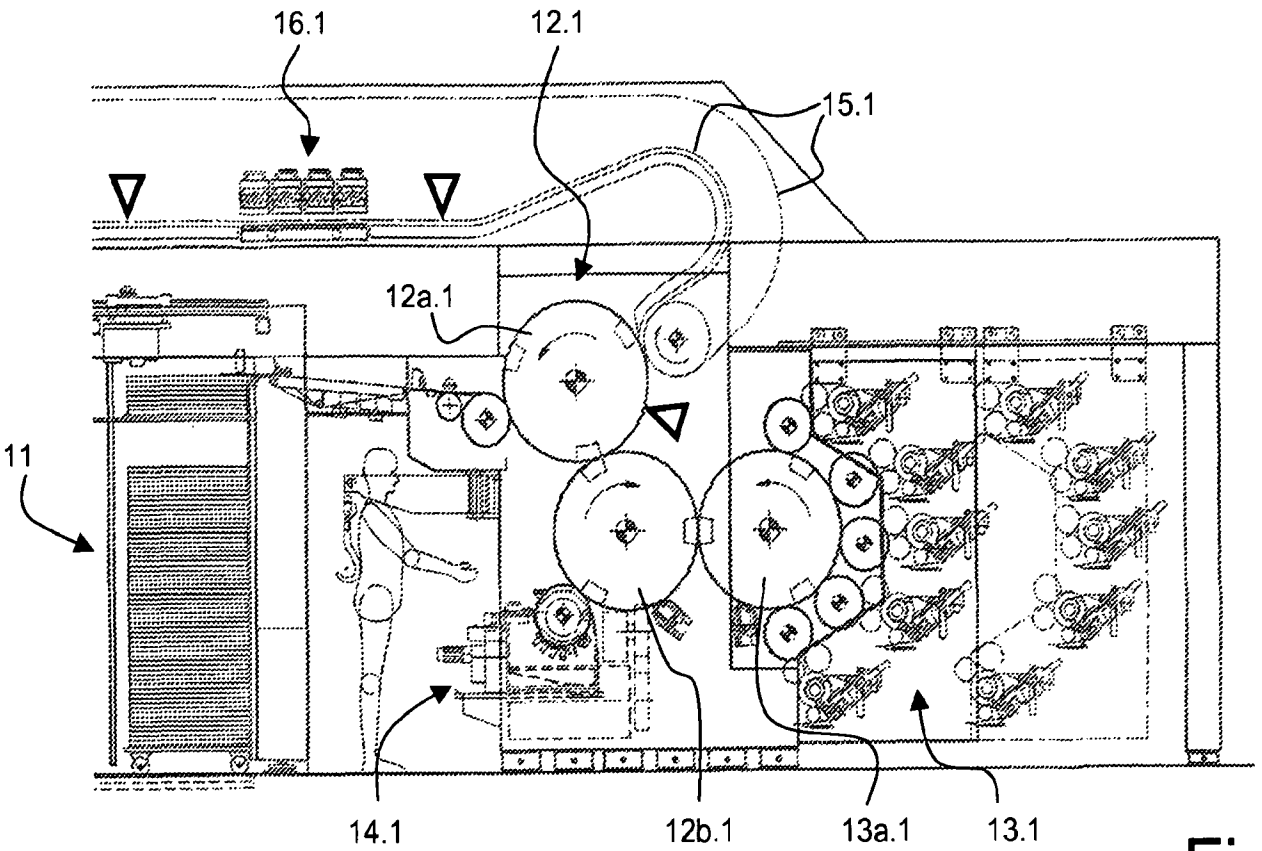

A second embodiment of the invention will now be described in reference to FIGS. 2*a* to 2*c*. It will be appreciated that FIGS. 2*a* to 2*c* are partially-overlapping side-view illustrations of one and the same intaglio printing press system, taken from left to right. According to this second embodiment the intaglio printing press system comprises first and second intaglio printing units 12.1, 12.2 respectively for recto and verso printing, which intaglio printing units 12.1, 12.2 are operatively-coupled to one another directly by a sheet transporting system comprising a chain conveyor system 15.1 with spaced-apart gripper bars for transporting the sheets from the first to the second intaglio printing units 12.1, 12.2. According to this second embodiment, the two intaglio printing units 12.1, 12.2 are disposed in a mirrored configuration (i.e. with the cylinders rotating in opposite directions) with the sheet feeding station 11 of the intaglio printing press system being located between the two intaglio printing units 12.1, 12.2 (see FIGS. 2*b* and 2*c*) and the sheet delivery station 18 of the intaglio printing press system being located at an outermost end of the intaglio printing press system, i.e. on the outermost left-hand side in the illustrated example (see FIG. 2*a*).

Besides, the chain conveyor system 15.1 which couples the two intaglio printing units 12.1, 12.2 runs in this example in a clockwise direction (i.e. in the same direction as the impression cylinder 12*a*.2 of the second intaglio printing unit 12.2), the sheets being accordingly transferred to the downstream-located second intaglio printing unit 12.2 on a lower part of the path of the chain conveyor system 15.1 (where the drying unit 16.1 and the inspection unit 17.1 are located).

More precisely, according to this second embodiment, the sheet transfer location between the impression cylinder 12*a*.1 of the first intaglio printing unit 12.1 to the chain conveyor system 15.1 is disposed at a side of the impression cylinder which is located, with respect to a vertical plane intersecting the rotation axis of the impression cylinder 12*a*.1 of the first intaglio printing unit 12.1, opposite to the second intaglio printing unit 12.2 (i.e. on the right-hand side of the impression cylinder 12*a*.1—see FIG. 2*c*).

At the sheet transfer location between the chain conveyor system 15.1 and the impression cylinder 12*a*.2 of the second intaglio printing unit 12.2 there is provided a transfer cylinder (or drum) 10.1, which transfer cylinder rotates in a counter-clockwise direction in the illustration, for transferring the sheets from the chain conveyor system 15.1 to the impression cylinder 12*a*.2 of the second intaglio printing unit 12.2.

In this way, the sheets are appropriately oriented for recto printing in the first intaglio printing unit 12.1 and verso printing in the second intaglio printing unit 12.2.

Figure 5A:
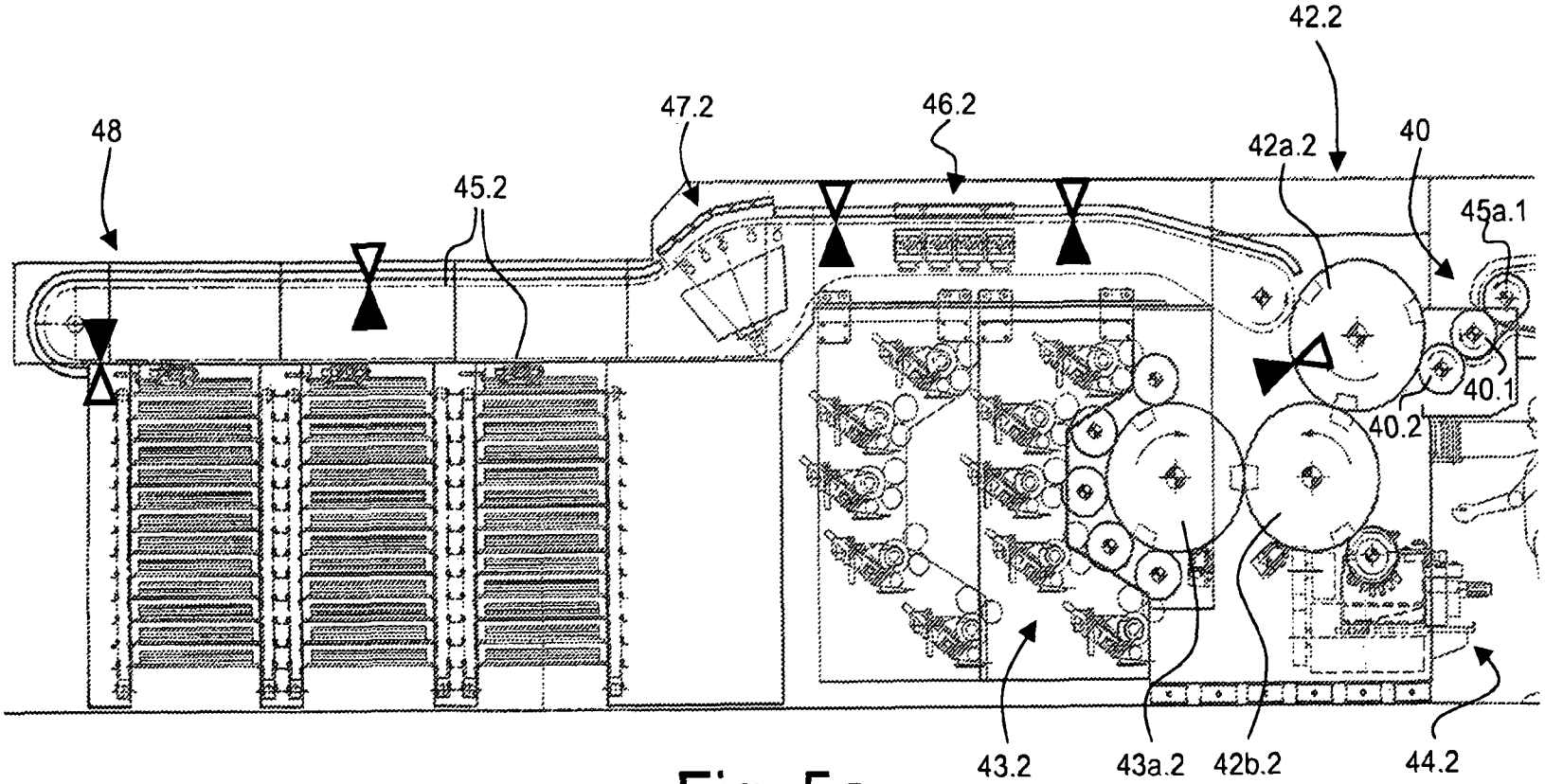
FIGS. 5*a* and 5*b* are schematic views of a fifth embodiment of an intaglio printing press system for recto-verso printing of sheets according to the invention.

A second drying unit for drying the verso side of the sheets is not illustrated in FIGS. 2*a*, 2*b* along the path of the chain conveyor system 15.2 leading to the delivery station 18. It will however be appreciated that a similar drying unit as drying unit 16.1 might be provided (in a manner similar to what is illustrated in FIG. 5*a*).

Figure 3A:
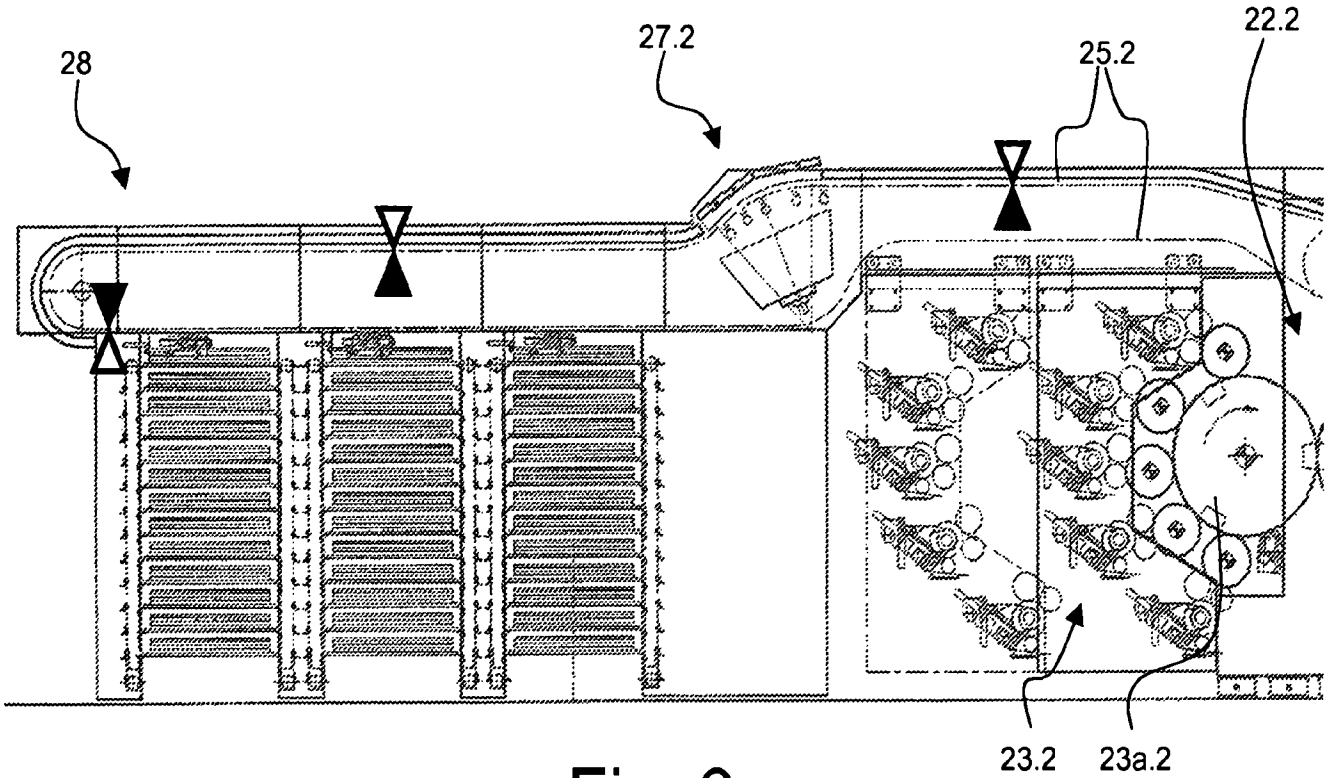
FIGS. 3*a* to 3*c* are schematic views of a third embodiment of an intaglio printing press system for recto-verso printing of sheets according to the invention.
Figure 3B:
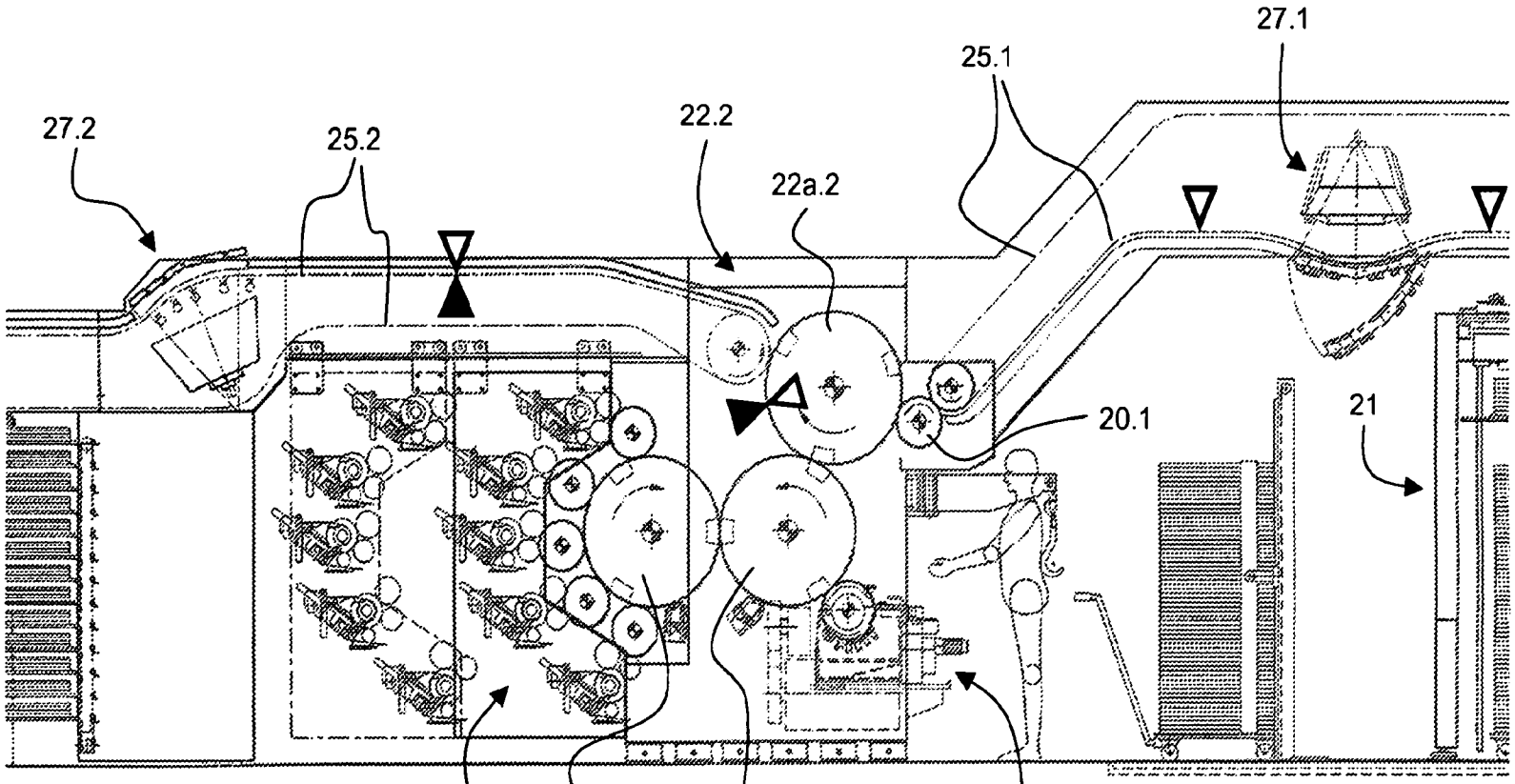
Figure 3C:
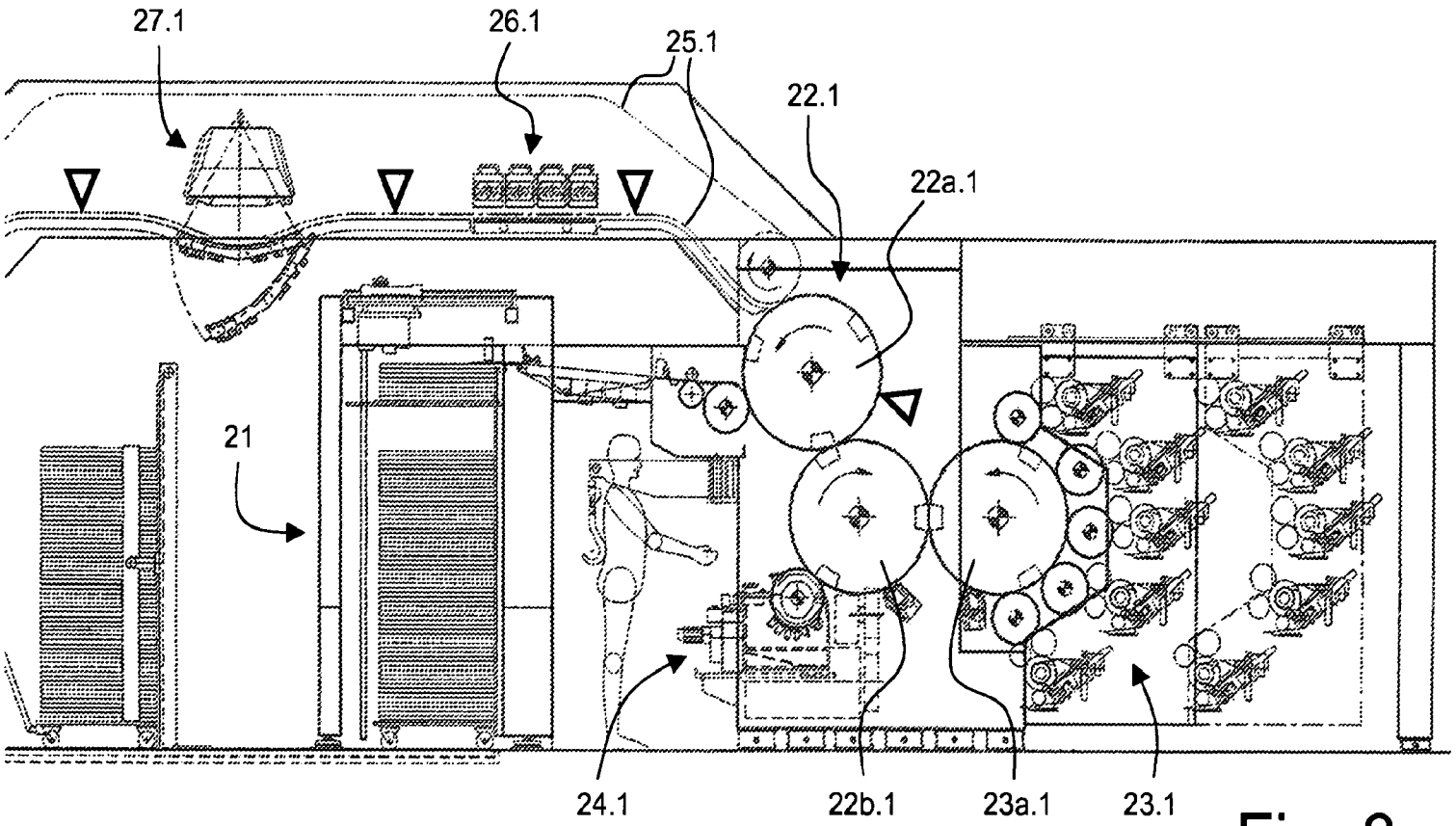

A third embodiment of the invention will now be described in reference to FIGS. 3*a* to 3*c*. It will be appreciated that FIGS. 3*a* to 3*c* are partially-overlapping side-view illustrations of one and the same intaglio printing press system, taken from left to right. This third embodiment is highly similar to the second embodiment of FIGS. 2*a* to 2*c*. The only difference resides in the actual configuration of the chain conveyor system 25.1 which operatively-couples the two intaglio printing units 25.1, 25.2 to one another. More precisely, according to this third embodiment, the sheet transfer location between the impression cylinder 22*a*.1 of the first intaglio printing unit 22.1 to the chain conveyor system 25.1 is disposed at a side of the impression cylinder 22*a*.1 which is located, with respect to a vertical plane intersecting the rotation axis of the impression cylinder 22*a*.1 of the first intaglio printing unit 22.1, on the same side as the second intaglio printing unit 22.2 (i.e. on the left-hand side of the impression cylinder 22*a*.1—see FIG. 3*c*). All other elements are identical to the second embodiment and do not accordingly need to be discussed again.

Figure 4A:
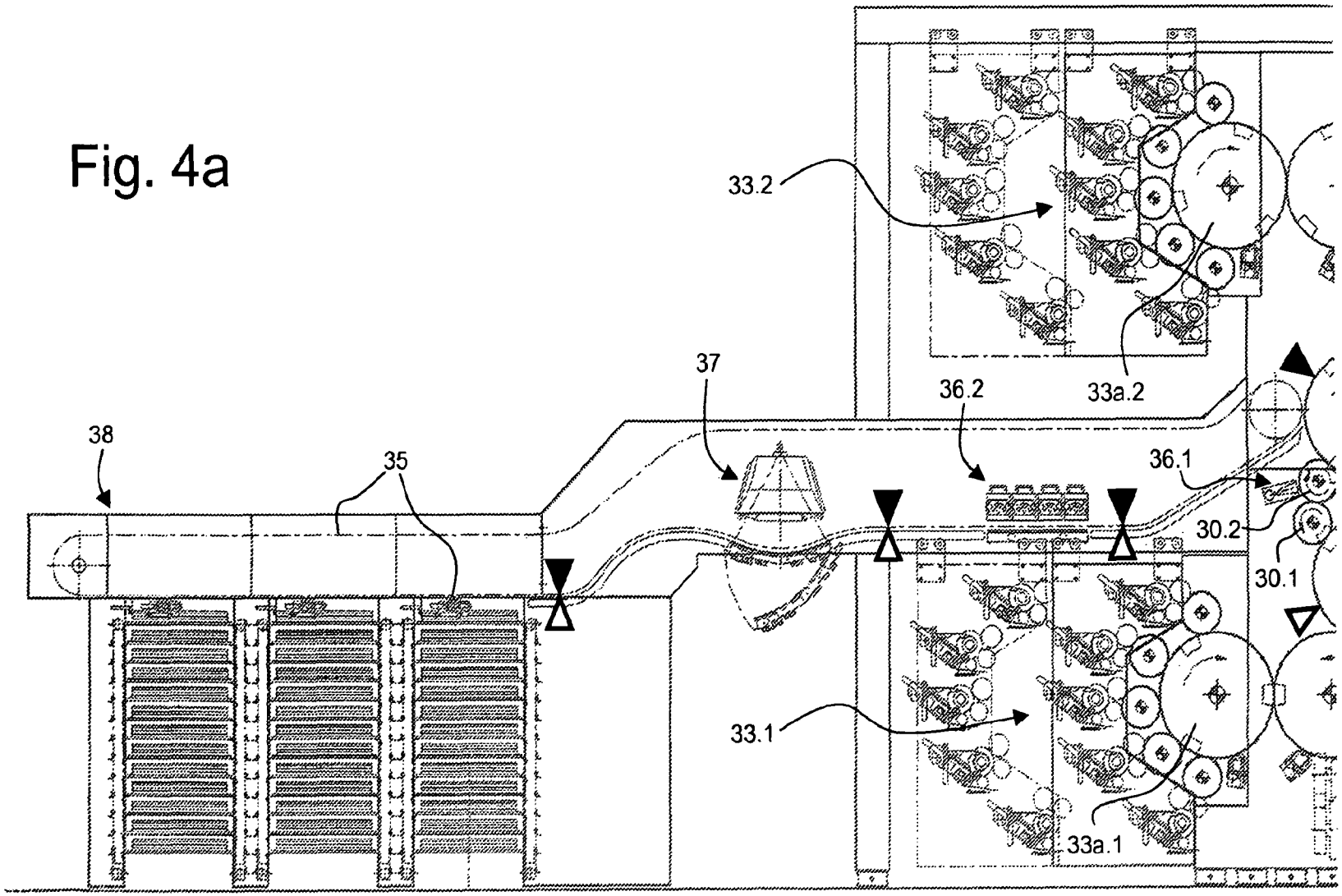
FIGS. 4*a* and 4*b* are schematic views of a fourth embodiment of an intaglio printing press system for recto-verso printing of sheets according to the invention.
Figure 4B:
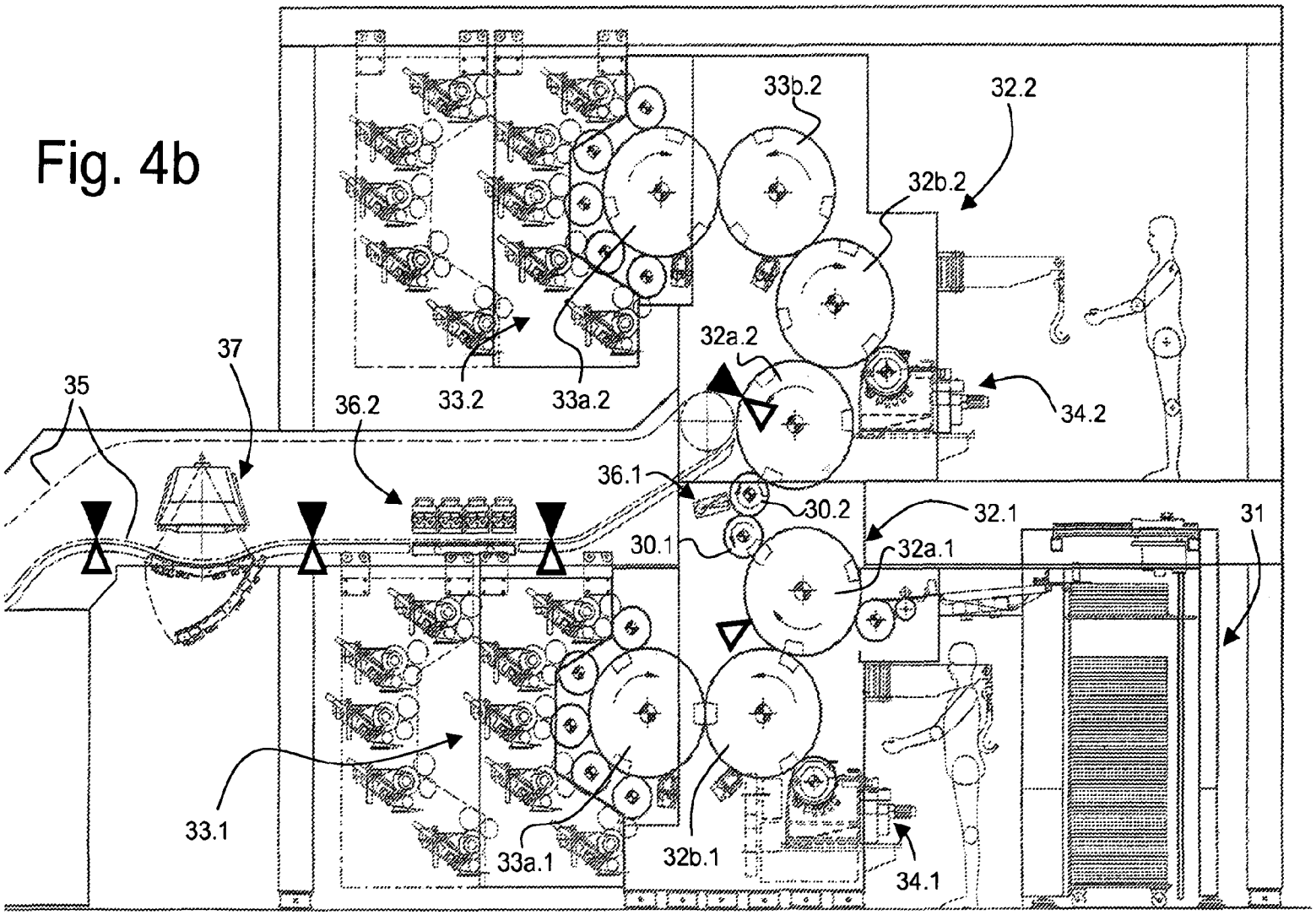

A fourth embodiment of the invention will now be described in reference to FIGS. 4*a* and 4*b*. It will be appreciated that FIGS. 4*a* and 4*b* are partially-overlapping side-view illustrations of one and the same intaglio printing press system, taken from left to right. According to this fourth embodiment the intaglio printing press system comprises first and second intaglio printing units 32.1, 32.2 respectively for recto and verso printing, which are disposed vertically, one on top of the other. The two intaglio printing units 32.1, 32.2 are operatively-coupled to one another directly by a sheet transporting system comprising a pair of transfer cylinders 30.1, 30.2. In contrast to the second and third embodiments, no chain conveyor system is used and a more compact printing press configuration is obtained as a result. While the height of the printing press system is increased as compared to the other embodiments, the foot-print of the system is similar to that of a conventional single-side intaglio printing press.

The two transfer cylinders 30.1, 30.2 are advantageously provided with an ink-repellent coating aimed at reducing smearing problems.

The first intaglio printing unit 32.1 is preferably located at the bottom of the system with the sheet feeding unit 31 (and preferably the sheet delivery station 38 as well) resting on the floor so as to facilitate loading of sheets to be printed onto the intaglio printing press system. The second intaglio printing unit 32.2 is accordingly located on top of the first intaglio printing unit 32.1.

According to this fourth embodiment, the impression cylinder 32*a*.1 and the plate cylinder 32*b*.1 of the first intaglio printing unit 32.1 and the impression cylinder 32*a*.2 and the plate cylinder 32*b*.2 of the second intaglio printing unit 32.2 are disposed in a mirrored configuration (a tandem configuration might alternatively be possible), i.e. the impression cylinder 32*a*.1 and the plate cylinder 32*b*.1 of the first intaglio printing unit 32.1 (which rotate respectively in a clockwise and counter-clockwise direction—see FIG. 4*b*) rotate in opposite direction as compared to the impression cylinder 32*a*.2 and the plate cylinder 32*b*.2 of the second intaglio printing unit 32.2 (which rotate respectively in a counter-clockwise and clockwise direction—see FIG. 4*b*).

In addition, according to the fourth embodiment, the inking systems 33.1, 33.2 of both intaglio printing units 32.1, 32.2 are disposed on the same side, with both ink-collecting cylinders 33*a*.1, 33*a*.2 rotating in the same direction (i.e. clockwise in the illustration of FIGS. 4*a* and 4*b*), thereby providing suitable access to the wiping systems 34.1, 34.2 of both intaglio printing units 32.1, 32.2. This implies that an intermediate ink-transfer cylinder 33*b*.2 is interposed between the ink-collecting cylinder 33*a*.2 and the plate cylinder 32*b*.2 of the second intaglio printing unit 32.2, as illustrated in FIG. 4*b*. This additional ink-transfer cylinder 33*b*.2 is preferably a cylinder having a same diameter as the ink-collecting cylinder 33*a*.2 (and the plate cylinder 32*b*.2 in this example).

According to this fourth embodiment, and in contrast to the previously-described embodiments, it will be appreciated that the chain conveyor system 35 which transports the sheets from the second intaglio printing unit 32.2 to the sheet delivery unit 38 runs in a clockwise direction, i.e. the freshly-printed sheets are transported to the sheet delivery unit 38 on a lower path of the chain conveyor system 35 (where the drying unit 36.2 and the inspection unit 37 are located). A drying unit 36.1 cooperates with the second transfer cylinder 30.2 in order to appropriately dry the recto-side of the sheets just printed in the first intaglio printing unit 32.1 prior to transfer thereof onto the surface of the impression cylinder 32*a*.2 of the second intaglio printing unit 32.2.

According to the fourth embodiment, an inspection of the recto-side of the printed sheets might also be carried out along the sheet delivery path of the printed sheets, or at any other suitable location.

A variant of the fourth embodiment of the invention may consist in adapting the configuration of the second intaglio printing unit 32.2 such that the inking system 33.2 would be located on the opposite side of the plate cylinder 32*b*.2 as compared to the fourth embodiment. According to this variant, an ink-transfer cylinder 33*b*.2 as in the fourth embodiment would not anymore be required.

Figure 5B:
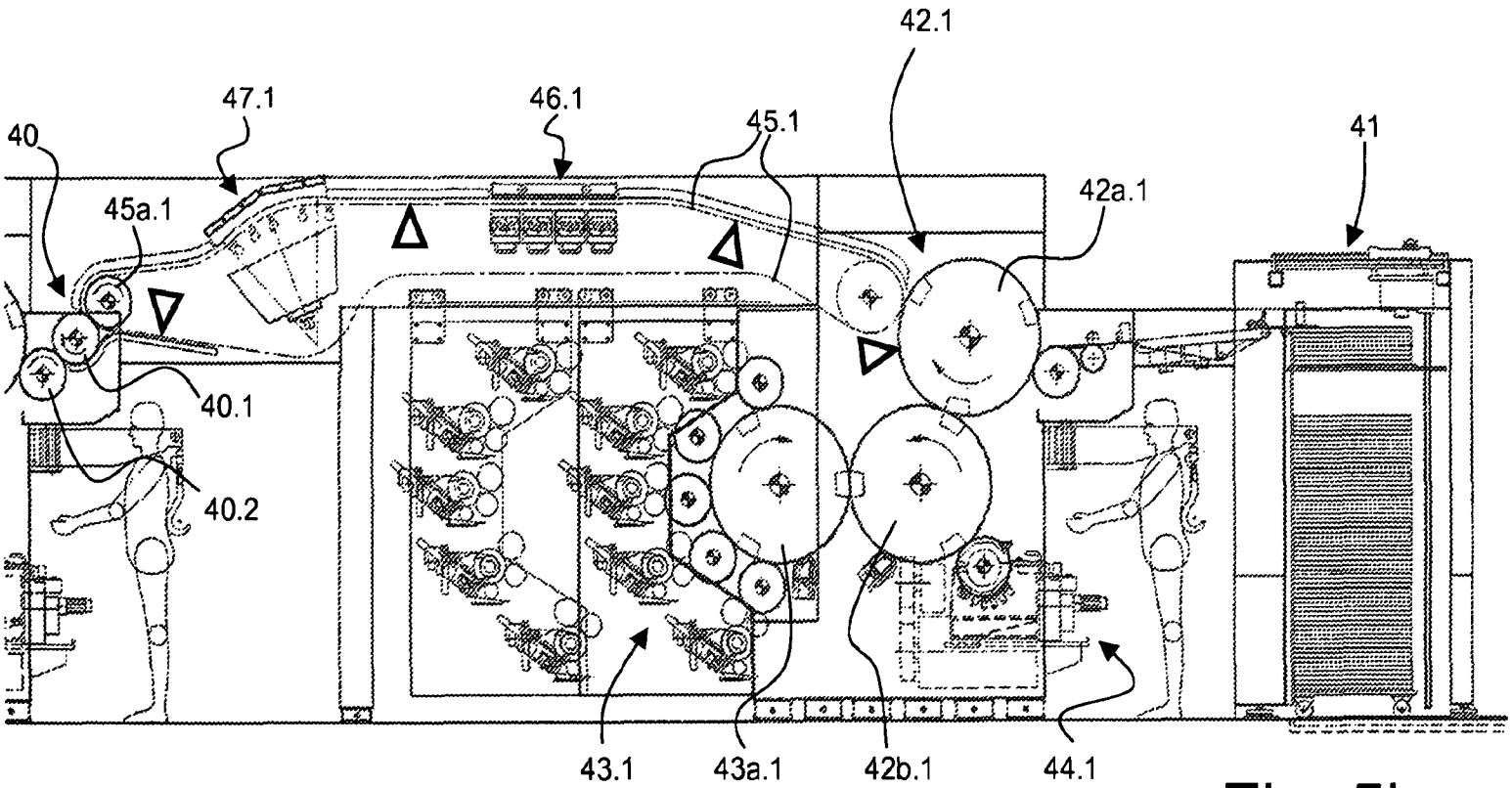

A fifth embodiment of the invention will now be described in reference to FIGS. 5*a* and 5*b*. It will be appreciated that FIGS. 6*a* and 6*b* are partially-overlapping side-view illustrations of one and the same intaglio printing press system, taken from left to right. This fifth embodiment is somewhat similar to the second and third embodiments in that the first and second intaglio printing units 42.1, 42.2 are operatively-coupled to one another directly by a sheet transporting system comprising a chain conveyor system 45.1 with spaced-apart gripper bars for transporting the sheets from the first 42.1 to the second intaglio printing unit 42.2. In contrast to the second and third embodiments, the two intaglio printing units 42.1, 42.2 are however disposed in a tandem configuration (i.e. with the cylinders 42*a*. 1, 42*b*.1, 43*a*. 1, 42*a*.2, 42*b*.2, 43*a*.2 rotating in the same direction). This implies that a sheet transfer arrangement must be provided along the path of the chain conveyor system 45.1 between the first and second intaglio printing units 42.1, 42.2 in order to transfer the sheet to the second intaglio printing unit 42.2 in the appropriate way for the verso side to be printed.

As the two intaglio printing units 42.1, 42.2 are disposed in a tandem configuration with the same sheet transporting and printing orientations, a similar sheet transfer configuration as in the case of the second and third embodiments is not possible. The sheet transfer arrangement necessary in the context of the fifth embodiment must be designed in such a way that the sheets coming from the first intaglio printing unit 42.1, which sheets are held at their leading edge by the gripper bars of the chain conveyor system 45.1 are transferred via their trailing edge to the downstream-located second intaglio printing unit 42.2. In other words, upon transfer of the sheets from the chain conveyor system 45.1 towards the second intaglio printing unit 42.2, the trailing edge of the sheets becomes the leading edge of the sheets, thereby enabling printing of the verso side of the sheets.

To this effect, the fifth embodiment is preferably provided with a sheet transfer arrangement 40 comprising first and second sheet transfer cylinders (or drums) 40.1, 40.2 interposed between the sheet transfer location of the chain conveyor system 45.1 and the impression cylinder 42*a*.2 of the second intaglio printing unit 42.2. The first transfer cylinder 40.1 (which performs reversal of the sheet transport direction) is synchronized with the passage of the sheets transported by the chain conveyor system 45.1 is such a way that the gripper means (not illustrated) of the first transfer cylinder 40.1 are brought in synchronism with the trailing edge of the sheet being transferred. This means that the chain conveyor system 45.1 holds the sheet to be transferred by its leading edge past the output chain wheels 45*a*.1 of the chain conveyor system 45.1 (over a distance substantially equal to the length of the sheet) until the trailing edge of the sheet is brought in the vicinity of the gripper means of the first transfer cylinder 40.1. Once the gripper means of the first transfer cylinder 40.1 have got hold of the trailing edge of the sheet, the gripper bar of the chain conveyor system 45.1 still holding the leading of the sheet is released so as to free the sheet and enable it to be transported further by the first transfer cylinder 40.1 in the opposite direction. The sheet is then transferred from the first transfer cylinder 40.1 to the second transfer cylinder 40.2 and then to the impression cylinder 42*a*.2 of the second intaglio printing unit 42.2. One will thus appreciate that while the sheet is still held by the chain conveyor system 45.1, the leading edge of the sheet is moved past the chain wheels 45*a*.1 (from left to right in FIGS. 5*a*, 5*b*) and, upon transfer to the first sheet transfer cylinder 40.1, is moved in the opposite direction (from right to left in FIGS. 5*a*, 5*b*). In all of the previously-described embodiments, the sheets are always transferred by way of their leading edge.

An alternate way of performing this leading edge-trailing edge transfer (or reversal) could consist is designing the chain conveyor system 45.1 is such a way that it gets hold of the sheets from the impression cylinder 42*a*.1 of the first intaglio printing unit 42.1, not by their leading edge, but by their trailing edge, in a manner similar to what has been described hereinabove.

It will be understood that various modifications and/or improvements obvious to the person skilled in the art can be made to the embodiments described hereinabove without departing from the scope of the invention defined by the annexed claims.

The invention claimed is:

1. An intaglio printing press system for recto-verso printing of sheets for the production of banknotes and securities, wherein the intaglio printing press system comprises first and second intaglio printing units each comprising an impression cylinder cooperating with a plate cylinder carrying at least one intaglio printing plate which is inked by an inking system and wiped by a wiping system, said first and second intaglio printing units being operatively-coupled to one another directly by a sheet transporting system for transporting the sheets from the first intaglio printing unit where recto printing is performed to the second intaglio printing unit where verso printing is performed, said first and second intaglio printing units being disposed vertically, one on top of the other.

2. The intaglio printing press system according to claim 1, wherein said impression cylinders and said plate cylinders of the first and second intaglio printing units are disposed in a mirrored configuration such that said impression cylinder and said plate cylinder of the first intaglio printing unit rotate in directions opposite to the directions of said impression cylinder and said plate cylinder of the second intaglio printing unit.

3. The intaglio printing press system according to claim 2, wherein the inking systems of the first and second intaglio printing units are located on a same side of the intaglio printing press system with respect to the plate cylinders.

4. The intaglio printing press system according to claim 1, wherein said sheet transporting system comprises a pair of transfer cylinders or drums for transporting the sheets directly from the impression cylinder of the first intaglio printing unit to the impression cylinder of the second intaglio printing unit.

5. The intaglio printing press system according to claim 1, wherein the first intaglio printing unit is disposed below the second intaglio printing unit with a sheet feeding station and a sheet delivery station resting on a floor part of the intaglio printing press system.

6. The intaglio printing press system according to claim 1, further comprising at least one drying unit for drying a recto or verso side of the sheets.

7. The intaglio printing press system according to claim 1, further comprising at least one inspection unit for controlling the printing quality of a recto or verso side of the sheets.

* * * * *